US008821255B1

(12) United States Patent
Friedman et al.

(10) Patent No.: US 8,821,255 B1
(45) Date of Patent: Sep. 2, 2014

(54) SLOT MACHINE PROMOTIONAL SYSTEM AND METHOD

(76) Inventors: Stacy A. Friedman, Beaverton, OR (US); Jon Muskin, Philadelphia, PA (US)

( * ) Notice: Subject to any disclaimer, the term of this patent is extended or adjusted under 35 U.S.C. 154(b) by 139 days.

(21) Appl. No.: 13/206,413

(22) Filed: Aug. 9, 2011

Related U.S. Application Data

(60) Provisional application No. 61/372,076, filed on Aug. 9, 2010.

(51) Int. Cl.
*A63F 9/24* (2006.01)

(52) U.S. Cl.
USPC ..... 463/25; 463/26; 463/27

(58) Field of Classification Search
USPC ..... 463/25, 26, 27
See application file for complete search history.

(56) References Cited

U.S. PATENT DOCUMENTS

| | | | |
|---|---|---|---|
| 5,326,104 | A | 7/1994 | Pease |
| 5,457,306 | A | 10/1995 | Lucero |
| 5,613,912 | A | 3/1997 | Slater |
| 5,655,961 | A | 8/1997 | Acres |
| 6,048,269 | A | 4/2000 | Burns |
| 6,110,044 | A | 8/2000 | Stern |
| 6,244,958 | B1 | 6/2001 | Acres |
| 6,257,981 | B1 | 7/2001 | Acres |
| 6,394,907 | B1 | 5/2002 | Rowe |
| 6,500,067 | B1 | 12/2002 | Luciano |
| 6,569,013 | B1 | 5/2003 | Taylor |
| 6,645,077 | B2 | 11/2003 | Rowe |
| 6,708,975 | B1 | 3/2004 | Fox |
| 6,729,958 | B2 | 5/2004 | Burns |
| 6,802,778 | B1 | 10/2004 | Lemay |
| 6,805,634 | B1 | 10/2004 | Wells |
| 6,811,486 | B1 | 11/2004 | Luciano |
| 6,857,957 | B2 | 2/2005 | Marks |
| 6,863,608 | B1 | 3/2005 | LeMay |
| 6,866,586 | B2 | 3/2005 | Oberberger |
| 6,875,107 | B1 | 4/2005 | Luciano |
| 6,905,411 | B2 | 6/2005 | Nguyen |
| 6,969,319 | B2 | 11/2005 | Rowe |
| 7,063,617 | B2 | 6/2006 | Brosnan |
| 7,153,206 | B2 | 12/2006 | Bennett |
| 7,169,052 | B2 | 1/2007 | Beaulieu |
| 7,192,350 | B2 | 3/2007 | Nguyen |
| 7,341,518 | B2 | 3/2008 | Muskin |
| 7,351,518 | B2 | 4/2008 | Abargues |

(Continued)

OTHER PUBLICATIONS

U.S. Appl. No. 11/678,617, filed Feb. 25, 2007, Friedman.

(Continued)

*Primary Examiner* — Pierre E Elisca
(74) *Attorney, Agent, or Firm* — Muskin & Farmer LLC

(57) ABSTRACT

A method to tracking a playing history chain of a cashless ticket. When an uncarded player first plays a slot machine and proceeds to cash out, inserts the latest ticket into another machine, plays, cashes out, inserts the latest ticket into yet another machine, plays, cashes out, etc., the entire chain of play can be automatically tracked. When the player redeems the ticket at a ticket redemption machine, the player can be presented with a message as to how many comp points the player would have earned had the player had and used a comp card. The player can also be presented with a voucher to be awarded the comp points if the player signs up for the casino's players (or slot) club.

8 Claims, 2 Drawing Sheets

(56) References Cited

U.S. PATENT DOCUMENTS

| | | | | |
|---|---|---|---|---|
| 7,419,428 | B2 | 9/2008 | Rowe | |
| 7,666,082 | B2 | 2/2010 | Kane | |
| 7,771,278 | B1 | 8/2010 | Muskin | |
| 7,819,742 | B2 | 10/2010 | Chamberlain | |
| 7,997,978 | B2 * | 8/2011 | Kaminkow et al. | 463/25 |
| 8,070,588 | B1 | 12/2011 | Muskin | 463/20 |
| 8,216,064 | B1 | 7/2012 | Muskin | 463/29 |
| 2002/0094871 | A1 | 7/2002 | Luciano | |
| 2002/0137217 | A1 | 9/2002 | Rowe | |
| 2002/0138594 | A1 | 9/2002 | Rowe | |
| 2002/0151366 | A1 | 10/2002 | Walker | |
| 2002/0177479 | A1 | 11/2002 | Walker | |
| 2002/0196342 | A1 | 12/2002 | Walker | |
| 2003/0032474 | A1 | 2/2003 | Kaminkow | |
| 2003/0036425 | A1 * | 2/2003 | Kaminkow et al. | 463/25 |
| 2003/0171145 | A1 | 9/2003 | Rowe | |
| 2003/0228912 | A1 | 12/2003 | Wells | |
| 2004/0032086 | A1 | 2/2004 | Barragan | |
| 2004/0127277 | A1 | 7/2004 | Walker | |
| 2004/0142742 | A1 | 7/2004 | Schneider | |
| 2004/0142750 | A1 | 7/2004 | Glisson | |
| 2004/0166928 | A1 | 8/2004 | Kumagai | |
| 2004/0229699 | A1 | 11/2004 | Gentles | |
| 2004/0248642 | A1 | 12/2004 | Rothschild | |
| 2004/0254005 | A1 | 12/2004 | Shackleford | |
| 2004/0254011 | A1 | 12/2004 | Muskin | |
| 2005/0119052 | A1 | 6/2005 | Russell | |
| 2005/0153773 | A1 | 7/2005 | Nguyen | |
| 2005/0170890 | A1 | 8/2005 | Rowe | |
| 2005/0181864 | A1 | 8/2005 | Britt | |
| 2005/0215316 | A1 | 9/2005 | Rowe | |
| 2005/0282626 | A1 | 12/2005 | Manfredi | |
| 2006/0058089 | A1 * | 3/2006 | White et al. | 463/13 |
| 2006/0068897 | A1 | 3/2006 | Sanford | |
| 2006/0082056 | A1 | 4/2006 | Kane | |
| 2006/0160612 | A1 | 7/2006 | Parham | |
| 2007/0050305 | A1 | 3/2007 | Klein | |
| 2007/0060274 | A1 | 3/2007 | Rowe | |
| 2007/0087841 | A1 | 4/2007 | Beaulieu | |
| 2007/0117616 | A1 | 5/2007 | Bartholomew | |
| 2007/0173310 | A1 | 7/2007 | Walker | |
| 2008/0051193 | A1 * | 2/2008 | Kaminkow et al. | 463/25 |
| 2008/0274792 | A1 | 11/2008 | Walker | |
| 2009/0124354 | A1 | 5/2009 | Acres | |
| 2009/0191962 | A1 | 7/2009 | Hardy | |
| 2010/0029376 | A1 | 2/2010 | Hardy | |

OTHER PUBLICATIONS

U.S. Appl. No. 13/544,390, filed Jul. 9, 2012, Muskin.
U.S. Appl. No. 13/311,272, filed Dec. 5, 2011, Muskin.

* cited by examiner

TICKET VALUE(CASH DISPENSED): $241.00

HAD YOU USED A PLAYER'S CLUB CARD, YOU WOULD HAVE EARNED 4,332 COMP POINTS BASED ON ALL OF YOUR PLAY AT THE 3 MACHINES YOU PLAYED. PLEASE SIGN UP TODAY!

FIGURE 2A

TICKET VALUE (CASH DISPENSED): $241.00

YOUR PLAY AT THE 3 MACHINES EARNED YOU 4,332 COMP POINTS. PLEASE TAKE THE BELOW DISPENSED VOUCHER TO A SLOT CLUB HOST AND JOIN OUR SLOT CLUB AND YOU WILL BE CREDITED THE 4,332 COMP POINTS PLUS 1,000 BONUS POINTS FOR JOINING THE CLUB!

FIGURE 2B

VOUCHER FOR:
4,332 COMP POINTS.

PLEASE PRESENT TO SLOT HOST AND SIGN UP TO RECEIVE THESE POINTS.

23432344

FIGURE 2C

SLOT MACHINE PROMOTIONAL SYSTEM AND METHOD

CROSS REFERENCE TO RELATED APPLICATIONS

This application claims benefit to provisional application 61/372,076, filed Aug. 9, 2010, which is incorporated by reference in its entirety for all purposes.

BACKGROUND OF THE INVENTION

Field of the Invention

The present general inventive concept is directed to a method, apparatus, and computer readable storage medium directed to a slot machine promotional system.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 2A is a sample output display on a TRM;

FIG. 2B is another sample output display on a TRM; and

FIG. 2C is a sample voucher for uncarded comp points.

DESCRIPTION OF THE PREFERRED EMBODIMENTS

Figure 1:
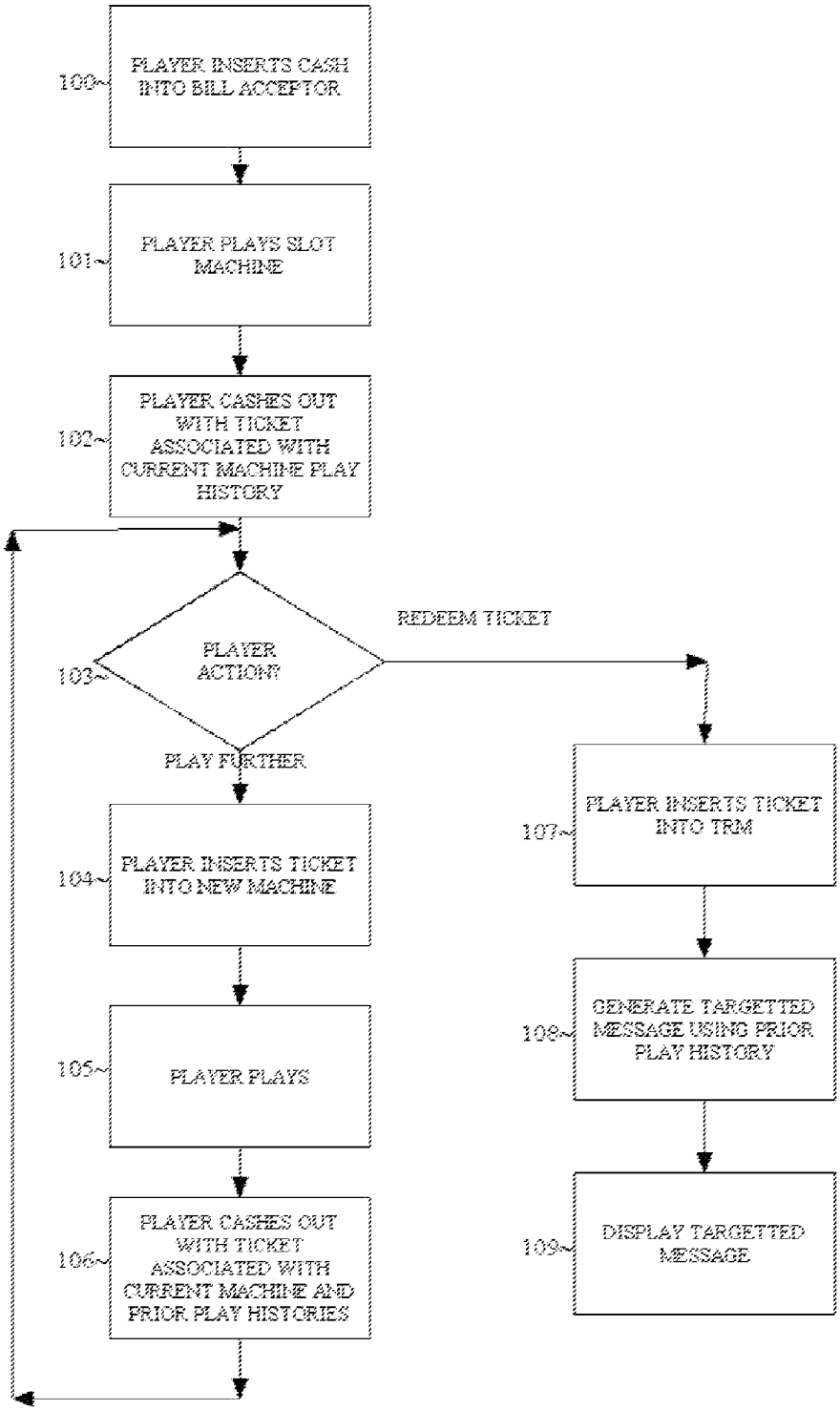
FIG. 1 is an flowchart illustrating an exemplary method of tracking a playing history chain associated with a ticket, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a system, method, and computer readable storage that can inform a non-carded player how many comp points the player would have earned had he or she used a comp card during their play and can also award the player those comp points.

The attached documents describe methods and systems to enable casinos to issue tickets to players and track information about that player's play to thereby provide personalized messages and bonus offers to the payer upon cashout and/or upon ticket redemption at a ticket redemption kiosk or ticket redemption machine (TRM). The methods that follow can be used with such methods and systems to provide further functionality.

A ticket trail can be maintained which stores the playing history of a particular ticket. For example, Bob deposits $100 into a slot machine A, plays for an hour, and then cashes out for $200 and receives a first ticket worth $200. The first ticket is associated with a record in the casino database of Bob's playing history on slot machine A (bets, wins/losses, outcomes, etc.). Bob now inserts the first ticket into slot machine B and plays for a couple hours, then cashes out for $50 (Bob loses $150 on slot machine B) and receives a second ticket worth $50. The second ticket is associated with the same record as the first ticket but now the record is augmented to include Bob's play on slot machine B (alternatively, a new record is created with Bob's playing history from both slot machine A and slot machine B, or multiple records are created but associated by the database. Any appropriate data management scheme may be used as known in the art). Bob can now insert the second ticket into slot machine C and play and cash out a third ticket. A record (or records) exists in the casino database which contains the entire playing trail for the third ticket, including Bob's play on machine C, prior play on machine B, and all the way back to Bob's initial deposit and gaming activity on machine A. There is no limit to the number of gaming machines that the playing trail will track, nor is there any temporal limit (a player can play on different days and still have his playing trail tracked).

Thus, even though a player has not used a comp card (although if a player does use a comp card a playing trail of a ticket can still be tracked), a record of the player's play can be maintained as to the player's activities prior to cashing out with a particular ticket. If the player inserts a ticket or cash into a machine and loses it all (and does not use his or her comp card), then that play could not be part of the trail of another ticket held by the player: zero-balance tickets are not typically printed, and as a result there would be no way for the system to match up that player's play to the player's other playing history. However, if zero-balance tickets were printed, or if cash were subsequently inserted (after going broke) and cashed out with a positive-balance ticket, the ticket trail could remain intact.

Thus, when the player redeems a ticket at a ticket redemption machine (TRM) and inserts his or her ticket, the ticket redemption machine can transmit information encoded on the ticket to a casino server/database that can retrieve the ticket's entire playing trail. This information can be used to present the player with a targeted message based on the trail or a targeted bonus offer. This can be particularly helpful when uncarded players (players who do not use their comp card, also known as players card or loyalty card) play.

When a player plays a series of machines and does not use a comp card in any of the machines, when the player inserts his or her ticket into the ticket redemption machine the targeted message that is displayed could display to the player the number of comp points that the player would have earned had the payer used a comp card for his or her play. For example, the message that is displayed at the ticket redemption machine at redemption can be, "Had you used your comp card you would have earned 1,234 comp points."

The number of comp points that the player would have earned can be computed as is known in the art, for example, based on the playing action (also known as "handle" or "total wager") for the playing sessions that were used to generate the final ticket that the player inserted into the ticket redemption machine. For example, suppose the player inserted cash into machine X, played machine X and cashes out a first ticket, inserted the first ticket into machine Y, played machine Y and cashes out a second ticket, inserts the second ticket into machine Z, played machine Z and cashes out a third ticket, and inserts the third ticket into a ticket redemption machine (TRM) in order to receive the cash value of the third ticket. Machines X, Y, Z are the only machines used to generate the third ticket, and in an embodiment the total amount wagered by the player on machines X, Y, and Z is associated with that third ticket. Of course, other numbers of machines can be used to generate a ticket as well (from at least one to a large number of machines (e.g., 100 or more)). If the player inserts cash into machine W and loses all of that cash, then of course that play is not one of the machines used to generate the third ticket since it is not part of the chain.

All of the gaming action the player provided to the casino can be tabulated for each of the machines used to generate the redeemed ticket, and in an embodiment the number of comp points that the casino would have awarded a carded player can be computed based on a predetermined formula. For example, a casino may award one comp point for every dollar wagered on gaming machines. Thus, upon redemption of a ticket, the system can compute (can be actually done at the TRM itself or at a computer in communication with the TRM) the total amount of dollars wagered by the player for all of the machines used to generate the ticket and then compute the number of comp points that would have been earned had the player used a comp card for each of those machines. Any known computation for comp points may be used, based on any one or more aspects of the player's play history that is associated with the ticket. Comp points may be computed based on all of the player's ticket-associated play history, or only some of the play history (as filtered or restricted by criteria determined by the casino, for example, only $1.00 wagers or higher, or only slot machines but not video poker machines, or only on play between 3 pm and 8 pm, etc.)

In a further embodiment, the TRM can dispense a voucher to the uncarded player which can be redeemed for the number of comp points that the player would have earned had he or she used a comp card.

For example, assume a player is not a member of the casino's players club. Typically, a player must sign up to become a member of the player's club and then the player receives a physical player's card (typically with an electronic encoding of the player's identification number so the card can be inserted into card readers associated with gaming machines). The marketing value to a casino of a carded player (a player using a loyalty card) is significantly higher than the value of an uncarded player. So when a player plays a chain of gaming machines and then redeems the final ticket into a ticket redemption machine, the TRM can display a message such as "your play from all 5 machines you played would have earned you 123 comp points." The TRM can also dispense a paper voucher that the player can present to the player's club (e.g., at their sign-up desk) to encourage the player to sign up for the player's club. The player would present the voucher, sign up, and receive the 123 comp points credited to the player's new account.

FIG. 1 is a flowchart illustrating an exemplary method of tracking a playing history chain associated with a ticket, according to an embodiment.

The method can begin with operation 100, wherein the player inserts cash into a bill acceptor associated with an electronic gaming machine. This can be done as known in the art. In addition the cash, the player can also fund his or her play using an electronic payment method (e.g., debit card) as well.

From operation 100, the method proceeds to operation 101, wherein the player plays the slot machine for a number of plays. Each play the player makes is recorded in a casino database, regardless of whether the player is using his or her players card (comp card) or not at the slot machine. Data recorded can be each bet made (the amount, paylines, etc.), timestamp of bet made, outcome, win/loss, etc.

When the player decides he or she is finished playing, the player can cash out in operation 102, and receive a ticket for the amount on the machine's credit meter. If the player has "busted out" (has no money left) then the player would simply walk away from the machine without receiving a ticket and the method would end. Alternatively, if the player re-inserts cash (or another ticket), then the play history can be continued.

The ticket the player would receive in operation 102 has a number (or other identifier) associated with it so a record can be retrieved from a casino database with information about the ticket. In addition to storing how much the ticket is worth, other information can be stored about the ticket as well (e.g., machine that printed it, time printed, etc.) In addition, this record can also store the playing history that occurred during the time the player played the slot machine in operation 101. The playing history can comprise each individual bet made and the amount, the outcome, the win/loss, the time made, etc.

From operation 102, the method proceeds to operation 103, wherein the player decides to either play further or redeem the ticket received (from either operation 102 or 106).

If in operation 103, the player decides to play further at a new machine, then the method proceeds to operation 104, wherein the player inserts the ticket in a new electronic gaming machine. The new electronic gaming machine credits the player with the cash value of the ticket inserted.

From operation 104, the method proceeds to operation 105, wherein the player plays at the new machine, and all the while the casino database is recording the playing history for this playing session at the new machine. The player history is the same or similar to the history that was being recorded in operation 101. This playing history can be recorded in a same record that the prior playing history from the ticket chain was stored. Alternatively, playing history from different sessions of a ticket chain can be stored separately and linked together.

From operation 105, the method proceeds to operation 106, wherein the player cashes out at the slot machine from operations 104-105 and receives a new ticket. The new ticket is associated with all of the prior play history associated with the ticket chain (play history from operation 101 and play history each time operation 105 was executed). If the player busted out then the player would not receive another ticket and the method would end.

From operation 106, the method proceeds to operation 103, wherein the player can choose to play another machine with the ticket received in operation 106 and proceed to operation 104, or redeem the ticket received in operation 106 and proceed to operation 107.

If the player decides to redeem the ticket (received in either operation 102 or 106), then the player proceeds to a ticket redemption machine (TRM) and inserts the ticket. The ticket would have a computer readable encoding (printed barcode, magnetic code, indicia, etc.) that is automatically read by the TRM and records for the ticket can be recovered. The TRM (and/or the casino database system) now can access the playing history of the entire chain for how the ticket was generated. This playing history encompasses play history from operations 101 and 105 (as many times as this operation is executed). This playing history can be stored and accessed even if the player never used his or her comp card at any of the machines played to generate the ticket. If the player did use his or her comp card at any of the machines played to generate the ticket the method can still operate similarly (in one embodiment). In another embodiment, the playing history can be associated with the player's loyalty card account if the player did use his or her comp card at any of the machines played to generate the ticket, even if the player did not use the comp card at all of the machines. In this way, the player is not penalized (that is, does not lose out on any comps or points) for forgetting to use their card at one or more machines.

From operation 107, the method proceeds to operation 108, which generates a targeted message using the playing history from all machines used to generate the ticket inserted in operation 107. The message can be generated by software running on the TRM itself or by a casino computer which serves the targeted message to the TRM for display.

In an embodiment, the number of comp points that the player would have earned via all of the player's playing history to generate the ticket (the ticket chain) can be computed (typically by multiplying a number of action the player has wagered in the ticket chain playing history by a constant). This amount can also be modified (e.g., adding on a bonus amount) as well (for example, a new player to sign up for a slot club can receive 1,000 comp points just for signing up). Thus, the message displayed to the player can be, "you would have earned 5,695 comp points from all of your play at the 4 machines you played at if you were a member of our players club!" Comp points that would have been earned by a player had the player used his or her comp card during the play can be known as "uncarded points."

In a further embodiment, the TRM can also display a message such as, "please take the voucher below to a slot club host and you will be credited with the 5,696 comp points." The TRM in addition to dispensing the cash for the ticket redemption, can also dispense a voucher which can be physically presented by the player to the slot club so that the player could join the slot club and receive those points credited to his or her account.

If the player is already a slot club member, then the casino may address this situation in numerous ways. In one embodiment, the casino would not let a player who is already a member add the points from uncarded play (uncarded points) to his or her current slot club account. Otherwise, this might encourage players to play without using their cards. In another embodiment, the casino would credit the player's already existing slot club account with the uncarded points (this can be done at the slot club desk or using an electronic kiosk), but would likely not honor the "sign-up" bonus amount (since the player was already signed up).

FIG. 2A is a sample output display on a TRM. This targeted message indicates to the player upon redemption of a ticket how many comp points the player would have earned had the player used a comp card for all of his or her play to generate the ticket in the ticket chain.

FIG. 2B is another sample output display on a TRM. This targeted message indicates to the player upon redemption of a ticket how many comp points the player would have earned had the player used a comp cad for all of his or her play to generate the ticket in the ticket chain. The TRM also dispenses (along with the cash) a voucher which can be used by the player to collect the uncarded comp points. Whether the player wishes to redeem the voucher and sign up for the slot club is of course at the player's option.

FIG. 2C is a sample voucher for uncarded comp points. The player can take the voucher to a slot host and sign up for (join) the slot club, upon which the player's new slot club account will have the uncarded comp points in it. The voucher may also contain an ID or record number (shown on the bottom left) which points to a record storing information about this voucher. The voucher may also contain a barcode (shown on the bottom right) which can be machine readable which points to the record.

If the player had used his or her comp card during play at all of the machines in the ticket chain, then of course the messages in FIGS. 2A, 2B and 2C would not be displayed since the player would be receiving credit for his or her play based on the comp card. Thus, another targeted message could be displayed to the player.

If the player had used his or her comp card at some but not all of the machines in the ticket chain, then the system could automatically credit the player's comp account with the uncarded play (in other words award the player's comp account the respective number of points) since the system knows the identity of the player since the player identified himself with the comp card at least once during the ticket chain.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method implemented in a casino, the method comprising:

receiving from a player, a cashless ticket in a ticket redemption machine;

determining that the player did not use a comp card when the player played at a gaming machine that issued the cashless ticket;

computing a number of comp points that the player would have earned based on the player's play on all of a plurality of gaming machines in a chain associated with the cashless ticket if a comp card was used; and displaying a message on an output device, the message indicating to the player the number of comp points.

2. The method as recited in claim 1, wherein the determining also determines that the player did not use the comp card on all of the machines in the chain associated with the cashless ticket.

3. The method as recited in claim 1, further comprising:

dispensing, by the ticket redemption machine, a voucher to the player that can be redeemed for the comp points.

4. The method as recited in claim 3, wherein when the player signs up to join a slot club at the casino, the player's slot club account will be credited with the comp points.

5. A casino system, comprising:

a plurality of gaming machines;

a ticket redemption machine, wherein the ticket redemption machine is configured to:

receive a cashless ticket from a player;

determine that the player did not use a comp card when the player played at a gaming machine that issued the cashless ticket; and display a message on an output device, the message indicating to the player a number of comp points, wherein the number of comp points is how many comp points that the player would have earned based on the player's play on all of a plurality of gaming machines in a chain associated with the cashless ticket if a comp card was used.

6. The apparatus as recited in claim 5, wherein the determine operation also determines that the player did not use the comp card on all of the machines in the chain associated with the cashless ticket.

7. The apparatus as recited in claim 5, wherein the ticket redemption machine is further configured to dispense a voucher to the player that can be redeemed for the comp points.

8. The apparatus as recited in claim 7, wherein a casino computer is configured such that when the player signs up to join a slot club at the casino, the player's slot club account will be credited with the comp points.

* * * * *